US010966541B2

(12) United States Patent
Sosa et al.

(10) Patent No.: US 10,966,541 B2
(45) Date of Patent: Apr. 6, 2021

(54) PORTABLE AND REMOVABLE WEIGHT BENCH SEAT COVER

(71) Applicants: George Sosa, Boynton Beach, FL (US); Craig Sydette Piper, II, Fort Lee, NJ (US)

(72) Inventors: George Sosa, Boynton Beach, FL (US); Craig Sydette Piper, II, Fort Lee, NJ (US)

( * ) Notice: Subject to any disclaimer, the term of this patent is extended or adjusted under 35 U.S.C. 154(b) by 0 days.

(21) Appl. No.: 16/508,169

(22) Filed: Jul. 10, 2019

(65) Prior Publication Data

US 2020/0046139 A1 Feb. 13, 2020

Related U.S. Application Data

(60) Provisional application No. 62/715,803, filed on Aug. 8, 2018.

(51) Int. Cl.

| | |
|---|---|
| ***A47C 31/11*** | (2006.01) |
| ***A47C 31/00*** | (2006.01) |
| ***A63B 21/078*** | (2006.01) |

(52) U.S. Cl.

CPC ..... *A47C 31/113* (2013.01); *A47C 31/007* (2013.01); *A63B 21/078* (2013.01); *A63B 2209/10* (2013.01); *A63B 2210/50* (2013.01)

(58) Field of Classification Search

CPC . A63B 21/078; A63B 2210/50; A47C 31/113; A47C 31/007

USPC ..... 297/228.12

See application file for complete search history.

(56) References Cited

U.S. PATENT DOCUMENTS

| | | | | |
|---|---|---|---|---|
| 4,693,511 | A * | 9/1987 | Seltzer | B60N 2/6054 297/224 |
| 4,958,886 | A * | 9/1990 | Barattini | B60N 2/58 297/229 |
| 5,265,933 | A * | 11/1993 | Croshaw | B60N 2/6063 297/228.1 |
| 6,345,866 | B1 * | 2/2002 | Jackson | A47C 31/11 297/224 |
| 8,225,422 | B1 * | 7/2012 | McSparron | A41B 13/005 2/67 |
| 8,770,662 | B2 * | 7/2014 | Mount | B60N 2/5825 112/403 |
| 2005/0110315 | A1 * | 5/2005 | Littlehorn | B60N 2/2812 297/219.12 |
| 2009/0026818 | A1 * | 1/2009 | Spitzer | A47C 31/11 297/228.1 |
| 2009/0276957 | A1 * | 11/2009 | Boitet-Ball | A47G 27/0237 5/420 |
| 2014/0265483 | A1 * | 9/2014 | Miller | A47C 31/11 297/228 |
| 2017/0253159 | A1 * | 9/2017 | Lopatin | B60N 2/6063 |
| 2019/0016243 | A1 * | 1/2019 | Pancol | B60N 2/60 |
| 2019/0029218 | A1 * | 1/2019 | Komatsubara | A01K 1/0353 |
| 2019/0142171 | A1 * | 5/2019 | Andrews | A45F 3/14 297/188.12 |
| 2020/0128969 | A1 * | 4/2020 | Strasser | A47C 1/11 |

* cited by examiner

*Primary Examiner* — Mark R Wendell

(57) ABSTRACT

A protective cover for weight training benches structured and arranged to permit a user to place and remove the cover from on the bench thereby protecting users from germs such as bacteria, sweat, that are transferred to the bench when in use.

2 Claims, 2 Drawing Sheets

PORTABLE AND REMOVABLE WEIGHT BENCH SEAT COVER

CROSS-REFERENCE TO RELATED APPLICATION

The present application is related to and claims priority from prior provisional application Ser. No. 62/715,803, filed Aug. 8, 2018 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. FIELD OF THE INVENTION

The present invention relates generally to the field of covering devices and more specifically relates to an portable and removable weight bench seat cover for weight training benches structured and arranged to permit a user to place and remove the cover from on the bench thereby protecting users from germs such as bacteria, sweat, that are transferred to the bench when in use.

2. DESCRIPTION OF THE RELATED ART

A weight training bench is a piece of equipment that has a resemblance to a normal bench but is designed for use in weight training. Weight training benches may be of various designs: fixed horizontal, fixed inclined, fixed in a folded position, with one adjustable portion, with two or more adjustable portions, with racks to hold bars, etc. into that of combinations that mix a bench and associated equipment. Unfortunately, when a user is weight training, bacteria and sweat and other germs may be transferred from the user to the bench prior to another user using the weight training bench unless cleaned after every use. Therefore a need exists for a protective covering device for use on a weight-training bench that may be easily removed after each use.

Ideally, a portable and removable weight bench seat cover should be user-friendly and safe in-use and yet would operate reliably and be manufactured at a modest expense. Thus, a need exists for a portable and removable weight bench seat cover for weight training benches structured and arranged to permit a user to place and remove the cover from on the bench thereby protecting users from germs such as bacteria, sweat, that are transferred to the bench when in use to avoid the above-mentioned problems.

BRIEF SUMMARY OF THE INVENTION

In view of the foregoing disadvantages inherent in the known covering devices art, the present invention provides a novel Portable and Removable Weight Bench Seat Cover. The general purpose of the present invention, which will be described subsequently in greater detail is to provide a portable and removable weight bench seat cover for weight training benches structured and arranged to permit a user to place and remove the cover from on the bench thereby protecting users from germs such as bacteria, sweat, that are transferred to the bench when in use.

A portable and removable weight bench seat cover comprising: a removable weight bench seat cover with a top side, a bottom side, and an elastic edge arranged around the circumference of the cover to hold the cover in place on a weight bench when in use; and at least one pair of adjustable straps with interlocking snap buttons arranged on the bottom side of the cover to hold the cover in place on the weight bench when in use.

A portable and removable weight bench cover set comprising: a carrying pouch with a wrist strap with a pair of interlocking snap buttons, and a zipper, a foldable, removable weight bench seat cover with a top side, a bottom side, an elastic edge arranged around the circumference of the cover to hold the cover in place on a weight bench when in use, and a pocket at an end on the bottom side of the cover; and at least one pair of adjustable straps with interlocking snap buttons arranged on the bottom side of the cover to hold the cover in place.

Wherein the pouch is openable and closeable via the zipper. Wherein the wrist strap is openable and closeable via the pair of interlocking snap buttons. Wherein the cover is foldable or stuffable or foldable and stuffable and fits inside the carrying pouch when folded or stuffed. Wherein the carrying pouch fits inside the pocket when the cover is unfolded. Wherein the cover comprises a material with anti-microbial, antifungal, or anti-microbial and anti-fungal properties. Wherein the elastic edge comprises a neoprene material.

The present invention holds significant improvements and serves as a Portable and Removable Weight Bench Seat Cover. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, a Portable and Removable Weight Bench Seat Cover, constructed and operative according to the teachings of the present invention.

The various embodiments of the present invention will hereinafter be described in conjunction with the appended drawings, wherein like designations denote like elements.

DETAILED DESCRIPTION

Figure 1:
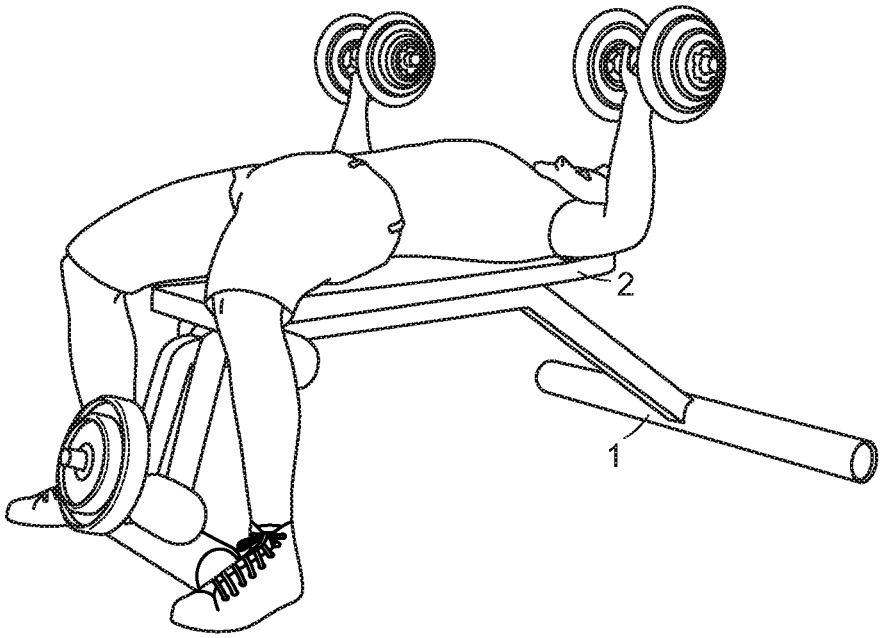
FIG. 1 shows a perspective view illustrating a portable and removable weight bench seat cover in an in-use condition according to an embodiment of the present invention.

As discussed above, embodiments of the present invention relate to a covering device and more particularly to a portable and removable weight bench seat cover for weight training benches structured and arranged to permit a user to place and remove the cover from on the bench thereby protecting users from germs such as bacteria, sweat, that are transferred to the bench when in use.

Generally speaking, the Portable and Removable Weight Bench Seat Cover is structured and arranged to permit a user to place and remove the cover from on the bench thereby protecting users from germs such as bacteria, sweat, that are transferred to the bench when in use. The present invention once placed over a weight training bench is kept in place via the elastic edges and a plurality of hook and loop fasteners along with a plurality of snaps. The present invention also includes a pouch for storing the Easy Fit when not in use and a pocket located on a bottom side of the present invention to have the pouch be inserted into when the Portable and Removable Weight Bench Seat Cover is in-use on a weight training bench.

To use the Portable and Removable Weight Bench Seat Cover, a user will unsnap at least one snap located on the carrying pouch to remove the cover. Then the user will wrap the cover around the weight training bench they will be using. The user may also use the optional fasteners provided to add extra securement of the Portable and Removable Weight Bench Seat Cover when in-use and to prevent unwanted displacement. When a user is finished weight training on the specific bench, they just remove the Portable and Removable Weight Bench Seat Cover and insert back into the carrying pouch for future use.

Referring to the drawings by numerals of reference there is shown in FIGS. 1-4 illustrating, perspective views illustrating Portable and Removable Weight Bench Seat Cover (2) according to an embodiment of the present invention.

Referring now to FIG. 1, a portable and removable weight bench seat cover (2) for standard weight training benches (1) is structured and arranged to permit a user to place and remove the cover (2) from on the bench (1) thereby protecting users from germs and bodily fluids, such as bacteria, funguses, and sweat, that are transferred to the bench when in use.

Figure 2:
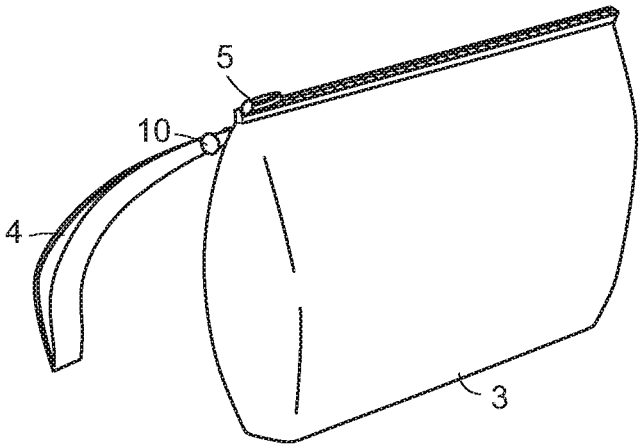
FIG. 2 is a perspective view illustrating a pouch of the portable and removable weight bench seat cover according to an embodiment of the present invention of FIG. 1.

Referring now to FIG. 2, the cover (2) fits inside a pouch (3) that closes with a zipper (5) and can be carried by a wrist strap (4). The pouch (3) makes the cover (2) easily portable. The wrist strap (4) can be opened with a pair of snap buttons (10) so that it can be opened and then closed with the snap buttons to attach it something such as the user's wrist, gym bag, or backpack.

Figure 3:
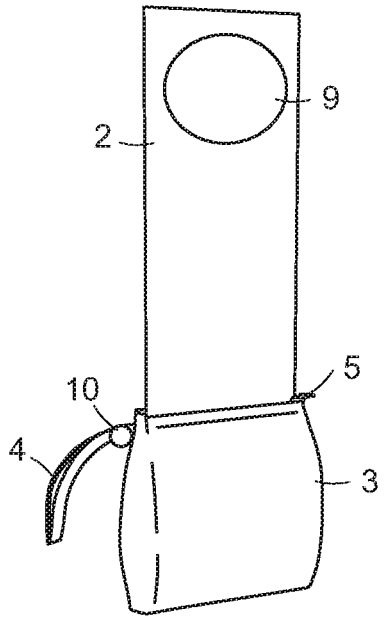
FIG. 3 is a perspective view illustrating cover having a pocket of the according to an embodiment of the present invention of FIG. 1.

Referring now to FIG. 3, the cover (2) is stored inside the pouch (3). The cover (2) has a pocket (9) at one end on its bottom side for storing the pouch (3) when the cover (2) is in use.

Figure 4:
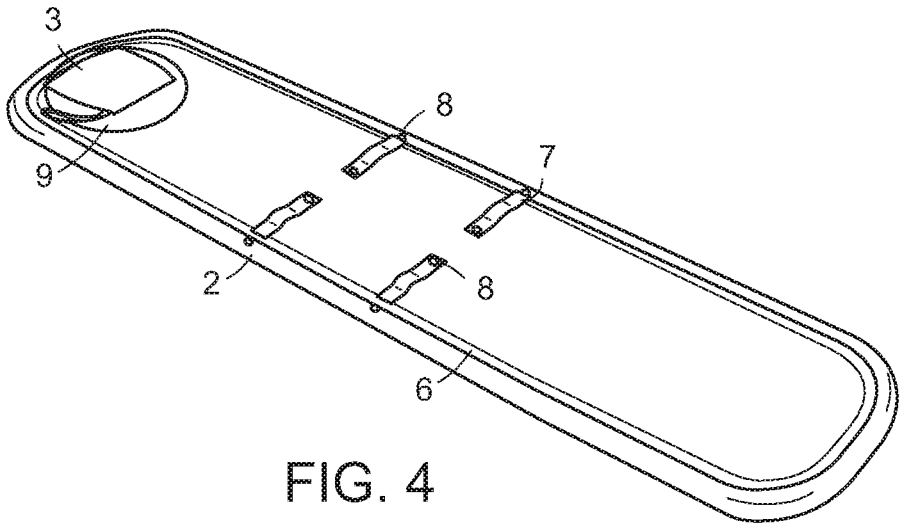
FIG. 4 is a perspective view illustrating the portable and removable weight bench seat cover kept in place via elastic edges and a plurality of hook and loop fasteners along with a plurality of snaps that attach under the bench (1 according to an embodiment of the present invention of FIG. 1.

Referring now to FIG. 4, the presently claimed invention, once placed over a standard weight training bench (1) is kept in place via the elastic edges (6) and a plurality of hook and loop fasteners (7) along with a plurality of snaps (8) that attach under the bench (1). The pouch (3) for storing the cover (2) when not in use is stored in a pocket (9) located on a bottom side of the cover (2) when the Easy Fit is in-use on a weight training bench (1). The elastic edges (6) may be made of neoprene or similar materials.

To use the portable and removable weight bench seat cover (2), a user will unsnap at least one snap or zipper (5) located on the carrying pouch (3) to open the pouch (3) and remove the cover (2). Then the user will wrap the cover (2) around the weight training bench (1) they will be using. The user may also use the optional fasteners (7, 8) provided to add extra securement of the Easy Fit when in-use and to prevent unwanted displacement. When a user is finished weight training on the specific bench (1), they just remove the portable and removable weight bench seat cover (2) and insert back into the carrying pouch (3) for future use.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A portable and removable weight bench cover set comprising:

(a) a carrying pouch with
  (i) a wrist strap with a pair of interlocking snap buttons, and
  (ii) a zipper, wherein the pouch is openable and closeable via the zipper, and wherein the wrist strap is openable and closeable via the pair of interlocking snap buttons; and (b) a removable weight bench seat cover with
  (i) a top side,
  (ii) a bottom side,
  (iii) an elastic edge arranged around the circumference of the cover to hold the cover in place on a weight bench when in use, wherein the elastic edge comprises a neoprene material, and
  (iv) a pocket at an end on the bottom side of the cover, wherein the cover is foldable and/or stuffable and fits inside the carrying pouch when folded and/or stuffed, and wherein the carrying pouch fits inside the pocket when the cover is unfolded and both the pocket and pouch are located on the bottom side of the cover when placed on the weight bench in use; and (c) at least one pair of adjustable straps with a plurality of hook and loop fasteners and interlocking snap buttons arranged on the bottom side of the cover to hold the cover in place on the weight bench when in use.

2. The portable and removable weight bench cover set according to claim 1, wherein the cover set further comprises:

at least two pairs of adjustable straps with a plurality of hook and loop fasteners and interlocking snap buttons arranged on the bottom side of the cover to hold the cover in place on the weight bench when in use.

* * * * *